US011667129B2

(12) United States Patent
Olgac et al.

(10) Patent No.: US 11,667,129 B2
(45) Date of Patent: Jun. 6, 2023

(54) ARRANGEMENT FOR SUPPLYING INK TO A PRINT BAR WITH SMALL PRESSURE FLUCTUATIONS AND WITH SMALL GAS FRACTION IN THE INK

(71) Applicant: Canon Production Printing Holding B.V., Venlo (NL)

(72) Inventors: Ender Olgac, Munich (DE); Christoph Rummelsberger, Ismaning (DE); Jochen Reinders, Isen (DE)

(73) Assignee: Canon Production Printing Holding B.V., Venlo (NL)

( * ) Notice: Subject to any disclaimer, the term of this patent is extended or adjusted under 35 U.S.C. 154(b) by 21 days.

(21) Appl. No.: 17/524,190

(22) Filed: Nov. 11, 2021

(65) Prior Publication Data

US 2022/0143984 A1 May 12, 2022

(30) Foreign Application Priority Data

Nov. 11, 2020 (DE) ..... 102020129787.4

(51) Int. Cl.
*B41J 2/175* (2006.01)

(52) U.S. Cl.
CPC ..... *B41J 2/17596* (2013.01)

(58) Field of Classification Search
CPC . B41J 2/175; B41J 2/18; B41J 2/17566; B41J 2/17596; B41J 2/19; B41J 2002/17579
See application file for complete search history.

(56) References Cited

U.S. PATENT DOCUMENTS

| | | | | |
|---|---|---|---|---|
| 8,550,612 | B2 * | 10/2013 | Park | B41J 2/17593 347/85 |
| 8,613,487 | B2 * | 12/2013 | Iwase | B41J 2/17509 347/85 |
| 10,919,303 | B2 * | 2/2021 | Hitzlsperger | B41J 2/17553 |
| 10,919,308 | B2 | 2/2021 | Hitzlsperger | |
| 11,173,720 | B2 * | 11/2021 | Hettier | B41J 2/175 |
| 2019/0389225 | A1 | 12/2019 | Yamazaki | |
| 2020/0290364 | A1 | 9/2020 | Hettler et al. | |

FOREIGN PATENT DOCUMENTS

| | | | |
|---|---|---|---|
| DE | 102018110845 | B3 | 7/2019 |
| DE | 102019106200 | B3 | 9/2020 |
| JP | H06336020 | A | 12/1994 |
| JP | 2007320285 | A | 12/2007 |
| JP | 2009160807 | A | 7/2009 |

OTHER PUBLICATIONS

German Search Report dated Jun. 30, 2021, Application No. 10 2020 129 787.4.

* cited by examiner

*Primary Examiner* — An H Do
(74) *Attorney, Agent, or Firm* — The Webb Law Firm

(57) ABSTRACT

An arrangement for supplying ink to a print bar with small pressure fluctuations may include an ink reservoir and a damping vessel. The print bar may include at least two print heads and is connected with the ink reservoir via a supply line. Each of the print heads is connected with the damping vessel via at least one damping line. The damping vessel is connected with a discharge line. The end of the damping line ends at a first height in the damping vessel. The end of the discharge line ends at a second height above the first height in the damping vessel. The arrangement may supply ink to the print bar with small gas fraction in the ink.

15 Claims, 8 Drawing Sheets

Figure 1A:
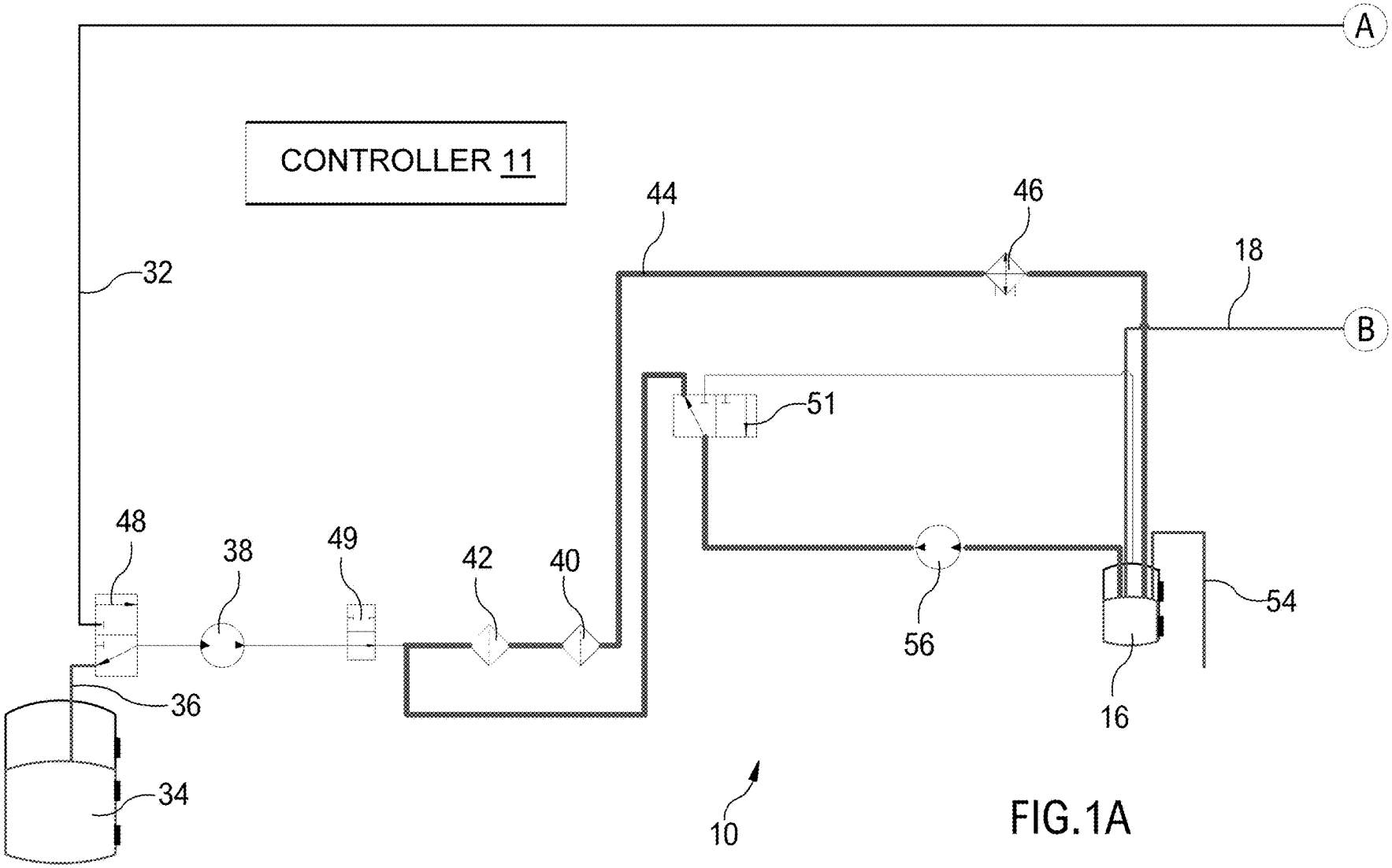

ARRANGEMENT FOR SUPPLYING INK TO A PRINT BAR WITH SMALL PRESSURE FLUCTUATIONS AND WITH SMALL GAS FRACTION IN THE INK

CROSS REFERENCE TO RELATED APPLICATIONS

This patent application claims priority to German Application No. 10 2020 129 787.4, filed on Nov. 11, 2020, which is incorporated herein by reference in its entirety.

BACKGROUND

Field

The disclosure relates to an arrangement for supplying ink to a print bar with small pressure fluctuations, in which the print bar comprises at least two print heads and is connected via a supply line to an ink reservoir. Furthermore, the disclosure relates to an arrangement for supplying ink to a print bar with small gas fraction in the ink.

Related Art

Document DE 10 2019 106 200 B3 discloses an ink supply system for a print bar of an inkjet printing device. The system comprises two supply lines for supplying ink to the print heads of the print bar. For this purpose, the print heads are respectively connected via a connecting line to both supply lines. In particular in the region of the supply lines in which the connecting lines are connected, as well as in further portions of the ink supply system, gas bubbles that may interfere with the function of the print heads and may thereby lead to incorrect print images may form after filling the ink supply system with ink and due to the entry of gas. In the prior art, service technicians have removed the gas bubbles upon commissioning or upon service operations. However, this is linked with a high effort and in particular leads to failures of the printing system if the gas bubbles negatively affect the quality of the generated print images.

Document DE 10 2018 110 845 B3 discloses an arrangement for supplying at least two print heads of a print bar of an inkjet printing device with ink. A respective sealed reservoir filled with air and ink is associated with each print head. The pressure in the respective supply container is measured, and an actuator associated with the respective reservoir is activated based on the determined measured value in order to convey ink as necessary into said reservoir.

Given known inkjet printing systems that have print bars having a plurality of print heads, damping vessels filled with air and ink are used that need to have a predetermined air/ink volumetric ratio for an optimal damping of pressure fluctuations upon supplying ink. This volumetric ratio is set manually by a service technician via an air-filled syringe. Due to the fact that the system is technically not 100-percent impermeable, the air or the ink in the damping vessel decreases, such that the damping vessel becomes empty or full due to defined utilizations of the print bar, in particular given a long printing time. However, a damping vessel completely filled with ink does not damp. By contrast, an empty damping vessel damps too strongly. In order to avoid this, a service technician needs to cyclically monitor and, if necessary, adjust the fill level. This process is linked with large effort and costs. The productivity of the inkjet printing system decreases.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 1A a first part of a block schematic of an arrangement for supplying ink to a print bar with small pressure fluctuations, according to an exemplary embodiment.

Figure 1B:
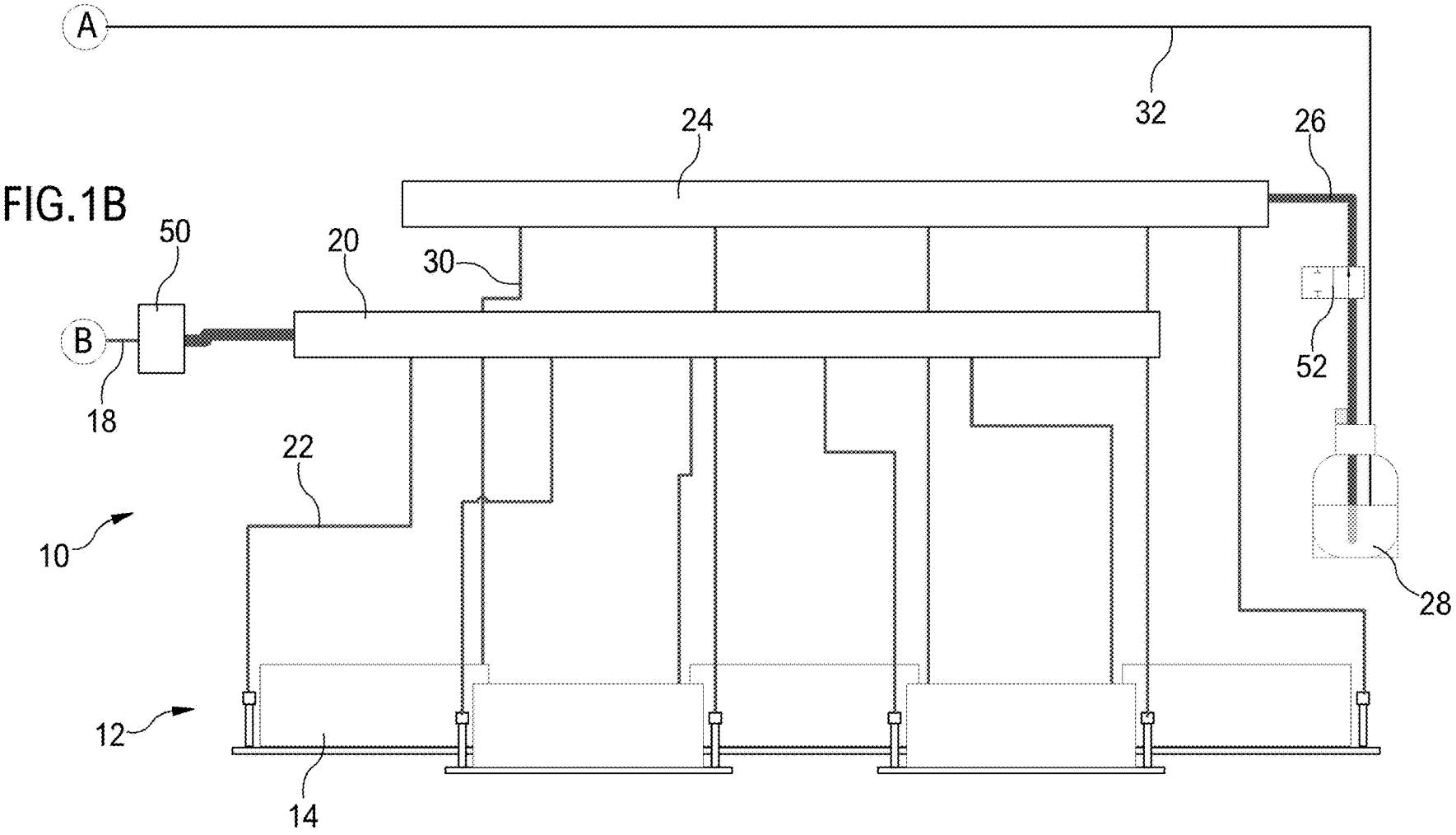

FIG. 1B a second part, complementary to the first part according to FIG. 1A, of a block schematic of an arrangement for supplying ink to a print bar with small pressure fluctuations, according to an exemplary embodiment.

Figure 2:
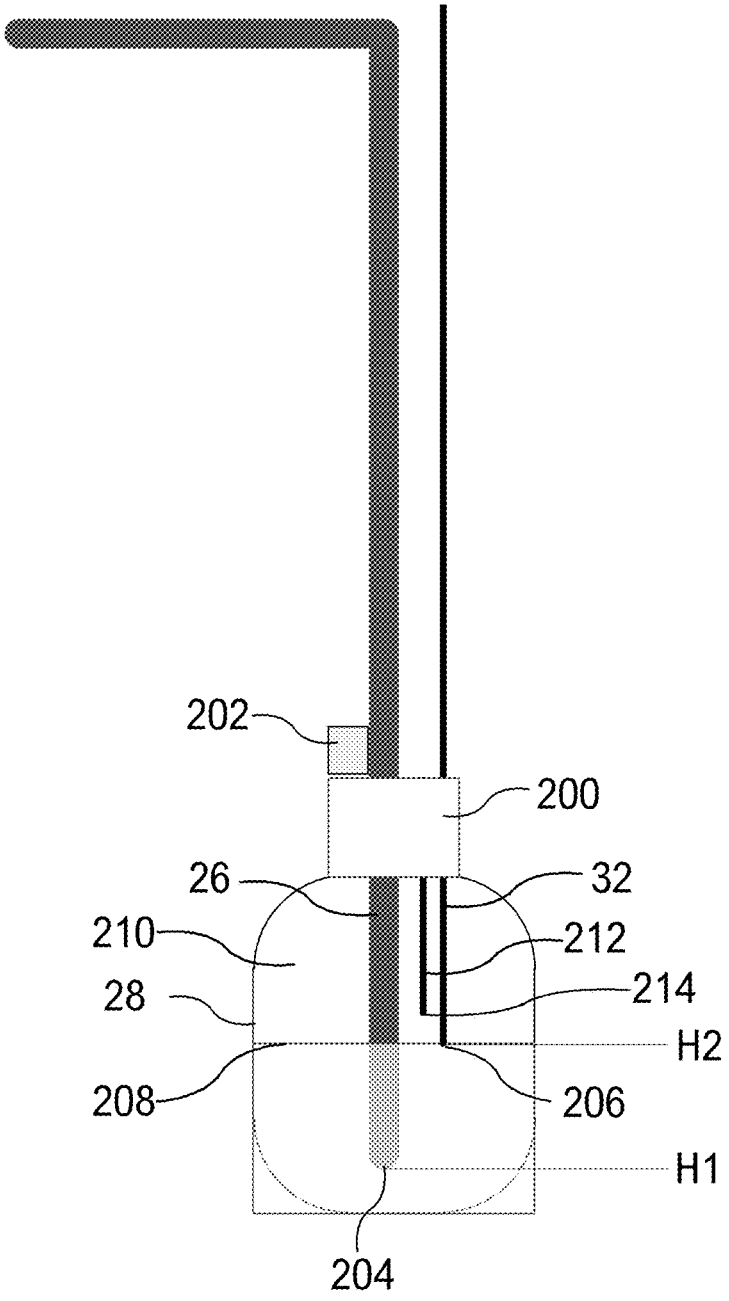

FIG. 2 a detail depiction of a damping vessel of the arrangement according to FIGS. 1A and 1B.

Figure 3A:
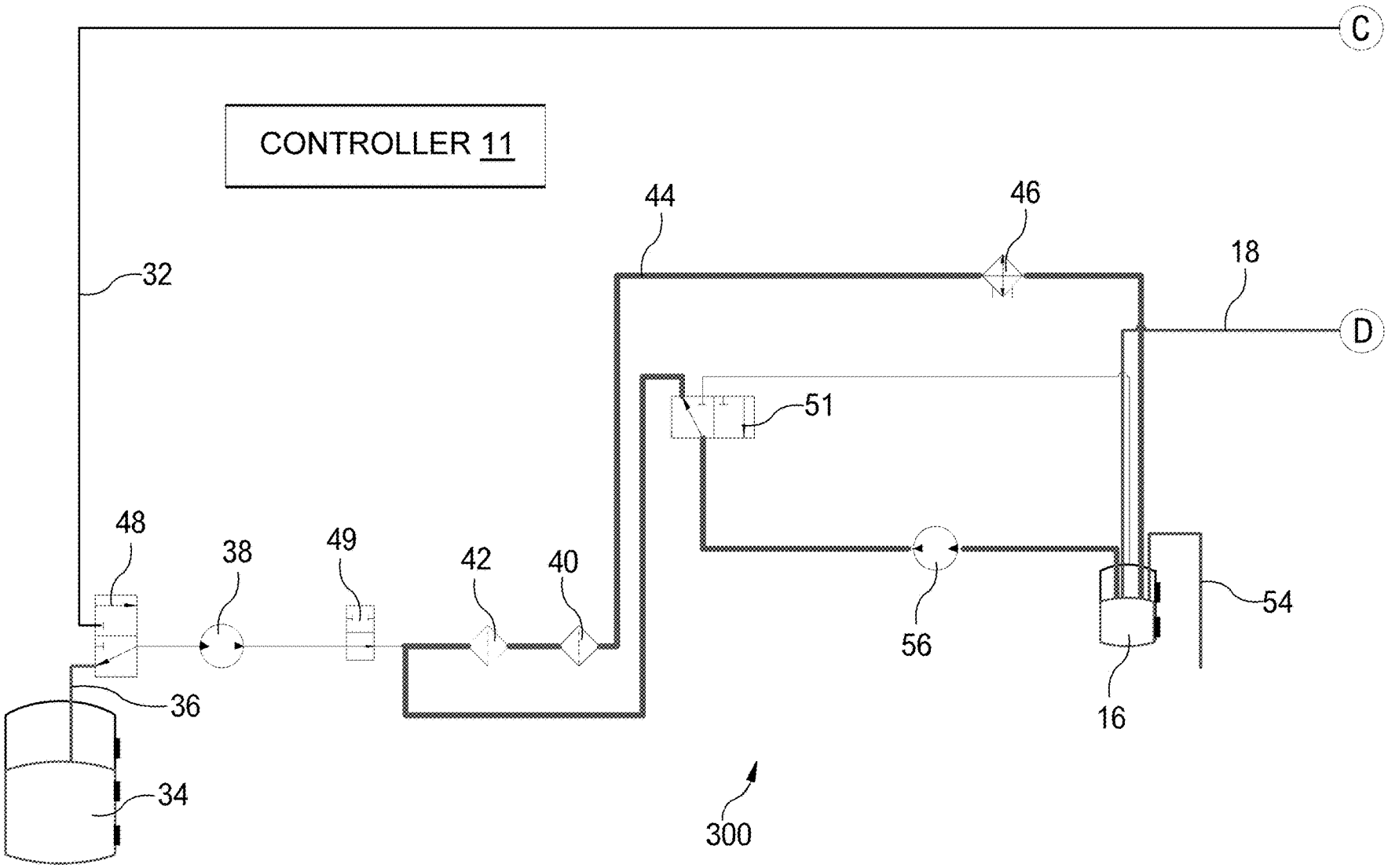

FIG. 3A a first part of a block schematic of an arrangement for supplying ink to a print bar with small gas fraction in the ink, according to an exemplary embodiment.

Figure 3B:
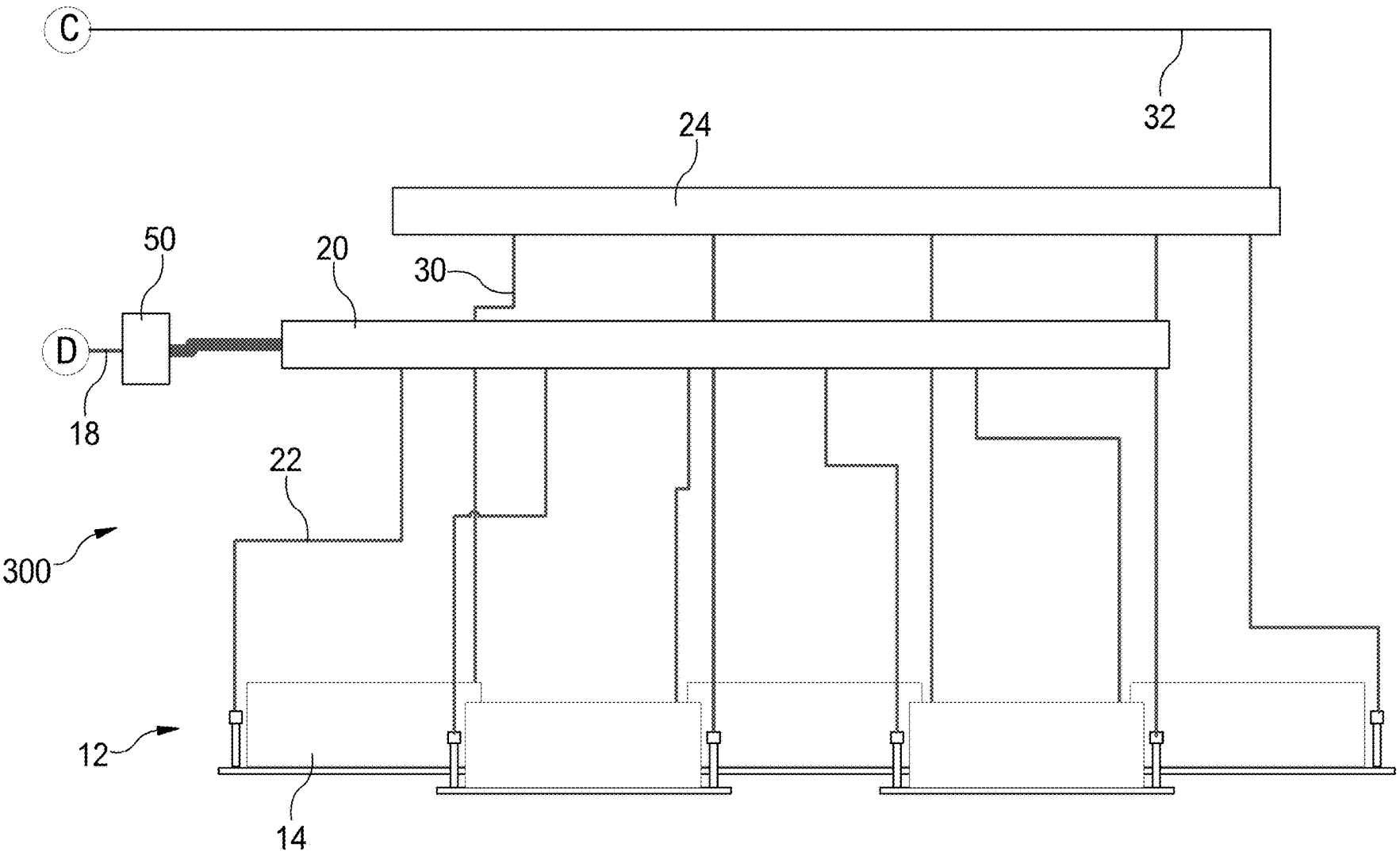

FIG. 3B a second part, complementary to the first part according to FIG. 3A, of a block schematic of an arrangement for supplying ink to a print bar with small gas fraction in the ink, according to an exemplary embodiment.

Figure 4:
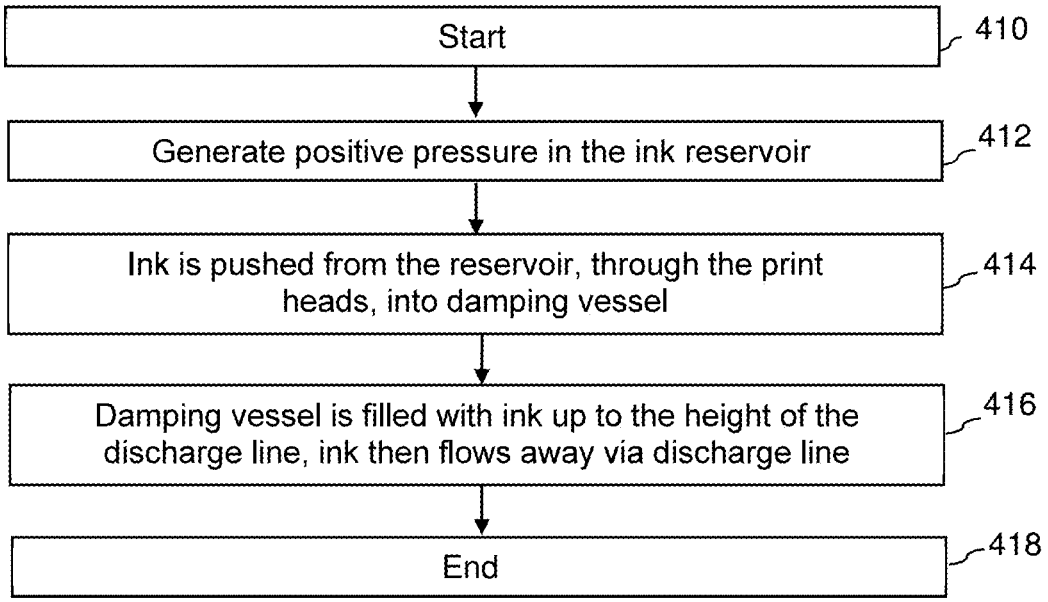

FIG. 4 a flowchart of a method for the adjustment of the damping volume of a damping vessel according to an exemplary embodiment.

Figure 5:
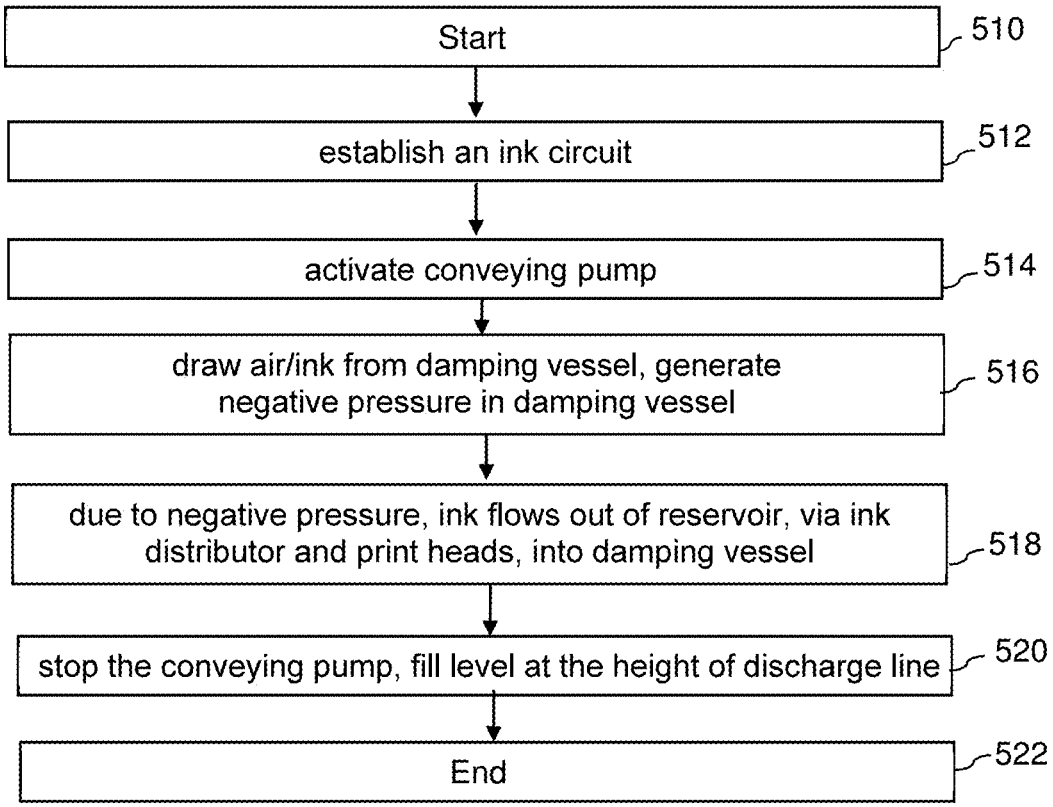

FIG. 5 a flowchart of a method for the adjustment of the damping volume of a damping vessel according to an exemplary embodiment.

Figure 6:
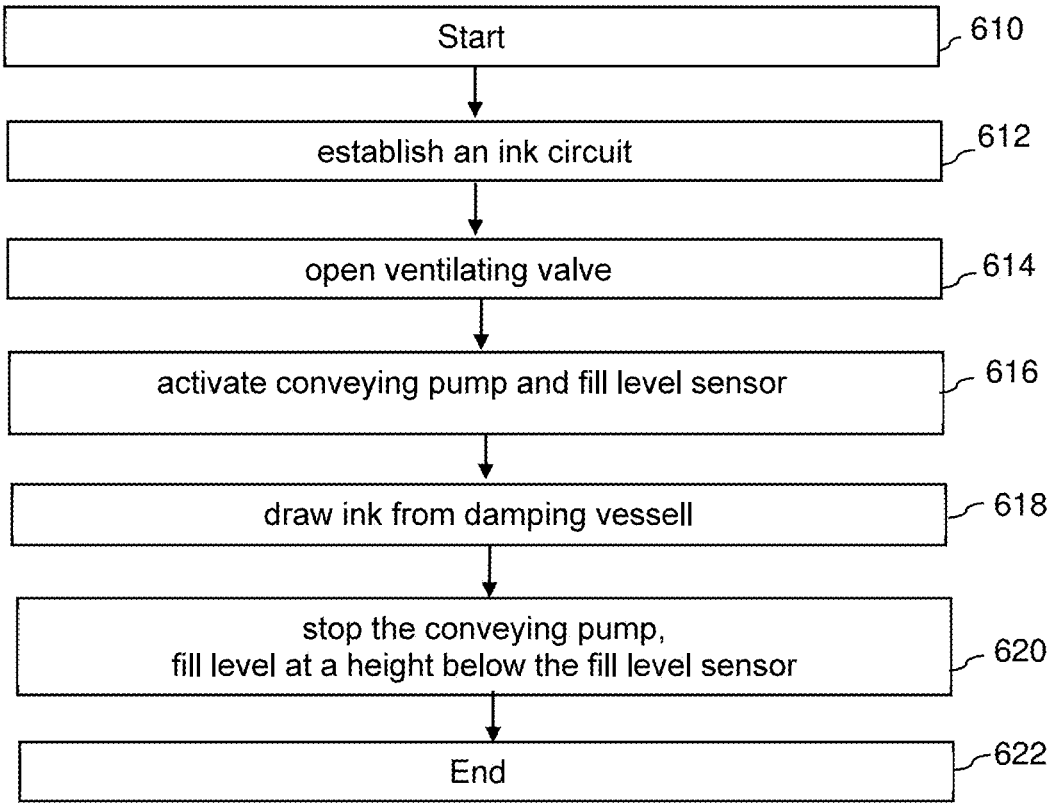

FIG. 6 a flowchart of a method for the adjustment of the damping volume of a damping vessel, according to an exemplary embodiment.

Figure 7:
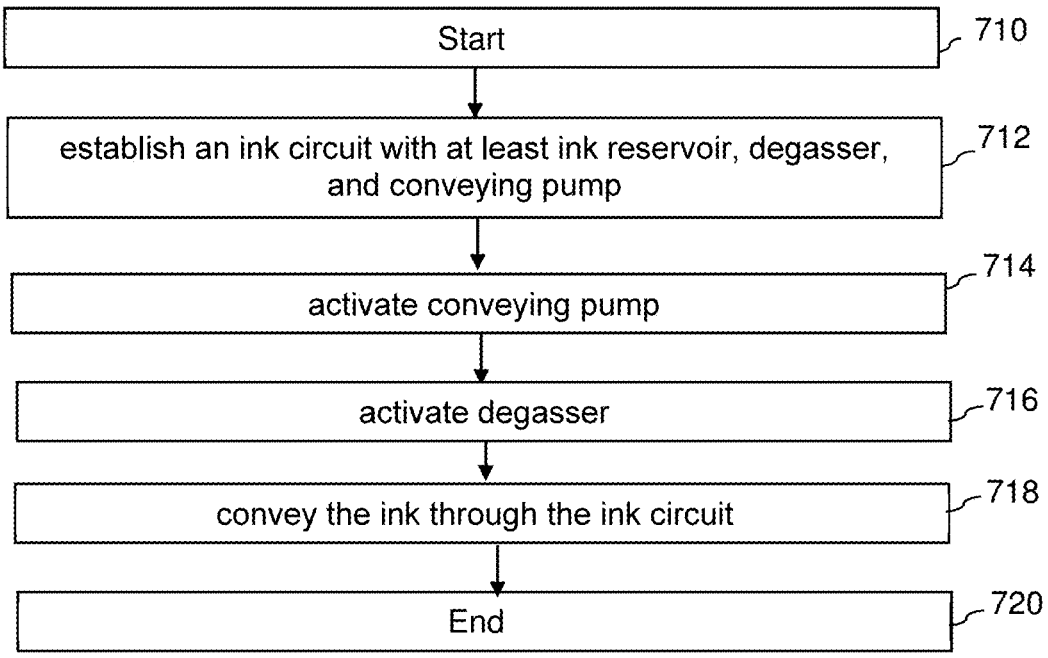

FIG. 7 a flowchart of a method for the degassing of ink contained in an ink reservoir, according to an exemplary embodiment.

Figure 8:
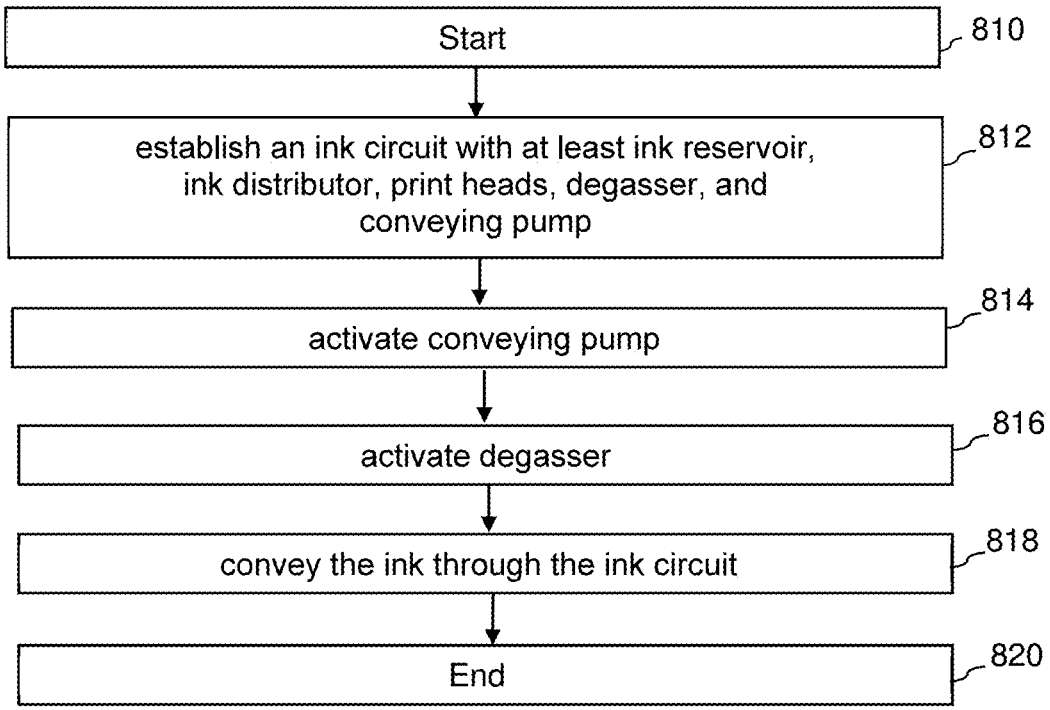

FIG. 8 a flowchart of a method for the degassing of an ink distributor and of a damping vessel, as well as of additional structural units arranged in the ink circuit, according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure. The connections shown in the figures between functional units or other elements can also be implemented as indirect connections, wherein a connection can be wireless or wired. Functional units can be implemented as hardware, software or a combination of hardware and software.

An object of the disclosure is to specify an arrangement for supplying ink to a print bar, in which the supplying of ink to print heads of a print bar is ensured in a simple manner.

This object is achieved via an arrangement for supplying ink to a print bar according to exemplary embodiments. Such arrangements may be used in inkjet printing systems.

Given an arrangement for supplying ink to a print bar with small pressure fluctuations according to a first aspect, each of the print heads is connected with a damping vessel via at least one damping line. The damping vessel is connected with a discharge line. One end of the damping line ends at a first height in the damping vessel. One end of the discharge line ends in the damping vessel at a second height, above the first height. The fill level of the ink in the damping vessel may hereby be simply set at the second height, so that the desired ink/air volumetric ratio in the damping vessel may be generated in a simple manner. A suitable damping of pressure fluctuations may thereby be achieved in particular in a supply line for supplying the print heads with ink. In particular, too high a negative pressure in the supply line is safely avoided via the damping vessel, even given high ink consumption by the print heads, since a pressure compensation with the ink located in the damping vessel takes place given an increasing negative pressure in the supply line, and the fluid level of the ink in the damping vessel hereby temporarily drops until sufficient ink has resupplied from the reservoir via the supply line.

Given an arrangement for supplying ink to a print bar with small gas fraction in the ink, according to a second aspect of the disclosure, the print bar comprises at least two print heads and is connected to an ink reservoir via a supply line. The supply line comprises at least one ink distributor to which ink can be supplied from the ink reservoir via the supply line. The ink distributor is connected with each of the print heads via a respective connecting line. Each of the print heads is connected with a discharge line to carry ink away from the print heads. The discharge line resupplies the removed ink to the ink reservoir. At least the ink reservoir, the supply line, the ink distributor, the print heads, and the discharge line form an ink circuit. The ink circuit furthermore comprises a means for transporting ink through the ink circuit, and a degasser.

Such a means for transporting ink may in particular be a pump, for example a gear pump. Valves arranged in the circuit are preferably opened or shifted such that ink in the circuit may circulate. A controller of the arrangement controls the means for transporting ink through the ink circuit to transport the ink through the circuit in a degassing operating mode. The entirety of the ink located in the circuit may hereby be conveyed once or multiple times through said circuit. The degassing operating mode differs from a printing operating mode for printing to recording material with the aid of the print heads in that, in printing operation, the print heads convey ink from the ink reservoir against a counterpressure or against a negative pressure.

In the first or second aspect, the ink reservoir is preferably arranged and designed such that a fill level of the ink reservoir is situated in a plane below the print nozzles of the print heads. A negative pressure of the ink is hereby generated in the region of the print nozzles, via which an unwanted exiting of ink from said print nozzles is prevented. The fill level in the ink reservoir is held in a preset range, in particular via resupplying ink from an ink tank, so that the negative pressure at the print nozzles is constant. Alternatively or additionally, the negative pressure at the print head nozzles may be adjusted by varying the fill level in the reservoir. At least the ink reservoir and the print heads with the print head nozzles form connected vessels. Due to the generation of the negative pressure at the print head nozzles via the fill level in the ink reservoir, the ink reservoir is also referred to as a backpressure tank.

If the arrangement comprises a damping vessel, this may comprise a ventilating valve, upon the actuation of which ink flows out of the damping vessel due to the negative pressure generated at the print nozzles, such that the fill level of the ink in the damping vessel may be lowered by actuating the ventilating valve. Given particularly advantageous embodiments, the ventilating valve may be automatically opened and closed via a corresponding activation of a controller. Additionally or alternatively, given an opened ventilating valve, ink may be pumped out of the damping vessel with the aid of a pump, preferably via a discharge line. The damping line may hereby be closed via the actuation of a valve.

It is particularly advantageous if the damping vessel has a fill level sensor that detects at least ink above the discharge line or above the second portion of the discharge line. Assuming a corresponding signal, given the presence of ink in the detection range of the sensor, the controller may then output an error message or open a ventilating valve to ventilate the damping vessel. Additionally or alternatively, given an opened ventilating valve, ink may be pumped out of the damping vessel with the aid of a pump, preferably via a discharge line. If the sensor no longer detects ink in the detection range, the controller activates the ventilating valve such that it is closed. If a pump for pumping ink out of the damping vessel has been activated, this is deactivated by the controller.

Furthermore, it is advantageous if the controller determines the ventilating time until the sensor no longer detects ink in the detection range. The determined time may then be compared with a limit value (threshold value) by the controller. Upon reaching or exceeding the limit value, an error message may then be generated and/or output. In the same manner, upon filling the damping vessel, the time of the activation of a pump until the detection of ink in the detection range of the sensor may be determined. The determined time may be compared with another limit value (threshold value). Upon reaching or exceeding the limit value, a further error message may then be generated and/or output.

If the arrangement comprises damping vessels, it is particularly advantageous if the discharge line or the second portion of the discharge line and/or the damping line is executed as a submerged line within the damping vessel. The submerged line may thereby be executed in particular as a hose or pipe. Alternatively or additionally, the discharge line or the second portion of the discharge line and/or the damping line may be connected with a respective lateral opening of the damping vessel. In particular, a connection may be provided at the lateral opening of the damping vessel, to which connection the discharge line or the second portion of the damping line or the damping line can be connected.

It is particularly advantageous if the arrangement according to the first aspect is a degasser via which gas inclusions, in particular air bubbles, may be extracted and removed from the ink.

It is also advantageous if the arrangement according to the first or second aspect comprises a heat exchanger via which ink located in the reservoir, or ink to be supplied to the print heads, should be brought to a desired nominal temperature.

Both the degasser and the heat exchanger may be arranged in the ink circuit of the respective arrangement for supplying ink to a print bar.

FIG. 1A shows a first part, and FIG. 1B a complementary second part, of a block schematic of an arrangement 10 for supplying ink to a print bar 12 with small pressure fluctuations, according to an exemplary embodiment. FIGS. 1A and 1B are to be merged at the connection points A-A and B-B into one block schematic. The arrangement 10 may be a component of an inkjet printing device.

The print bar 12 of the arrangement 10 comprises five print heads 14 that respectively print a part of a print image onto a recording medium (not shown). The inkjet printing devices normally comprise a plurality of print bars that respectively print one color onto the recording medium. Each of these print bars 12 of the arrangement 10 may respectively be supplied with with ink. In other embodiments, the print bars 12 may also comprise more or fewer than five print heads 14.

In order to supply the print bars 12 with ink, ink flows from an ink reservoir 16, through a supply line 18, via an ink distributor 20, to the print heads 14 of the print bars 12. Each print head 14 is thereby connected with the ink distributor 20 via a connecting line 22.

Furthermore, the print heads 14 of the print bar 12 are connected with a damping vessel 28 via a damping distributor 24 and a damping line 26. In the printing operation, i.e. upon printing print images onto the recording medium, the damping vessel 28 is hermetically sealed against the environment and contains air and ink in a predetermined volumetric ratio. Every print head 14 is thereby connected with the damping distributor 24 via a connecting line 30. A discharge line 32 is additionally connected with the damping vessel 28 and the ink reservoir 16. Depending on negative pressure in the print heads 14 upon printing, ink may flow both from the damping line 26 into the damping vessel 28 and from the damping vessel 28 into the damping line 26. Depending on the fill level of the ink in the damping vessel 28, ink may flow via the discharge line 32 from the damping vessel 28 back into the ink reservoir 16.

The ink distributor 20, the print heads 14, and the damping vessel 28, in particular the nominal fill level of the ink in the damping vessel 28, are arranged with relation to a nominal fill level of the ink reservoir 16 so that the fill level in the ink reservoir 16 is lower than, meaning below in a horizontal plane, the nominal fill level of the ink in the damping reservoir 28. The print heads 14 and the damping vessel 28 are arranged essentially in one plane.

In an exemplary embodiment, the arrangement 10 also comprises a first pump 38 and a second pump 56 configured to pump the ink through the lines or tubes of the arrangement 10. The pumps 38, 56 may be gear pumps, for example. Ink may flow in the described ink circuit to pump ink from an ink tank 34, via an immersion tube 36, into the ink reservoir 16 with the aid of the pump 38. The ink is thereby pumped through a portion 44 of the discharge line 32 in which are arranged a filter 42 and a degasser 40. The filter 42 removes unwanted particulate matter and/or solids from the ink. The degasser 40 removes gas inclusions from the ink, in particular air bubbles and/or gases dissolved in the ink. Furthermore, a heat exchanger 46 is provided with the aid of which the temperature of the ink may be adapted or regulated.

In an exemplary embodiment, the arrangement 10 furthermore comprises a plurality of valves 48, 49, 50, 51, 52 for regulation of the ink flow rate. With the aid of the 3/2-way valve 48, the ink tank 34 may be connected to the ink circuit, or the ink circuit may be closed so that a connection is established from the damping vessel 28 to the ink reservoir 16 via the discharge line 32. Furthermore, what is known as a purge valve 50 is provided with which the ink distributor 20 may be separated from the ink reservoir 16. Moreover, a damping valve 52 is provided via which the damping distributor 24 may be separated from the damping vessel 28.

A pressure line 54 connected with the ink reservoir 16 is also provided, which pressure line 54 is connected with a pressure source, in particular a compressor. It is thereby possible to selectively apply a positive pressure in the ink reservoir 16 for what is known as purging. Upon purging, the print nozzles of the print heads 14 are cleaned in that ink is pushed through the print nozzles. The damper valve 52 may be closed upon purging.

FIG. 2 shows a detailed depiction of the damping vessel 28 of the arrangement 10 according to FIGS. 1A and 1B. The damping vessel 28 has a closure 200 through which the damping line 26 and the discharge line 32 are guided into the damping vessel 28. The closure 200 thereby hermetically seals the damping vessel 28. Furthermore, the closure 200 comprises a ventilating valve 202 via which a pressure compensation with the environment may take place so that the pressure in the damping vessel 28 may be equalized with the ambient pressure. The ventilating valve 202 may be operated manually by a service technician, or via a corresponding activation by a controller 11 of the arrangement 10 or of the inkjet printing system. The controller 11 may be connected with one or more components of the arrangement 10 and/or of the inkjet printing system via one or more wireless and/or wired connections. The various connections are not illustrated for brevity and clarity of the drawings, but would be understood by one of ordinary skill in the art. In an exemplary embodiment, the controller 11 includes processing circuitry that is configured to control one or more components of the arrangement 10 and/or of the inkjet printing system, and/or control the overall operation of the arrangement 10 and/or of the inkjet printing system. Given a corresponding position of the valves 48, 49, 50, 51, 52, an opening of the ventilating valve 202 results in ink flowing out of the damping vessel 28 and the print bar 12, via the damping line 26 and the supply line 18, into the lower-situated ink reservoir 16.

One end 204 of the damping line 26 is arranged at a first height H1 within the damping vessel 28. One end 206 of the discharge line 32 is arranged at a second height H2 within the damping vessel 28. The second height H2 is thereby arranged above the first height H1. In the state shown in FIG. 2, the damping vessel 28 is filled with ink so that the fill level 208 is at the second height H2 or, respectively, so that the ink is up to the end 206 of the discharge line 32 in the damping vessel 28. A head volume 210 above the second height H2 is filled with gas, in particular air, and is also referred to as a damping volume. If the fill level 208 reaches the second height H2, as depicted in FIG. 2, ink may flow into the discharge line 32 or be pumped away via the discharge line 32.

The damping vessel 28 also comprises a fill level sensor 212 whose detection region 214 is arranged above the second height H2. The fill level sensor 212 measures the ink fill level in the damping vessel 28; in particular, the sensor 212 measures whether the ink fill level has reached or exceeded the detection region 214 of the sensor 212.

Alternatively or additionally, an additional fill level sensor may be provided that measures the fill level below the second height H2. Furthermore, in a further alternative embodiment, no fill level sensor at all is provided.

FIG. 3A shows a first part, and FIG. 3B a complementary second part, of a block schematic of an arrangement 300 for supplying ink to a print bar 12 with low gas fraction in the ink. FIGS. 3A and 3B are to be merged into one block schematic at the connection points C-C and D-D. The arrangement 300 may be part of an inkjet printing device. Elements having the same design or the same function have the same reference character.

In contrast to the exemplary embodiment according to FIGS. 1A and 1B, the arrangement 300 according to FIGS. 3A and 3B comprises no damping vessel 28. In the arrangement 300, ink may flow through the discharge line 32, from the damping distributor 24 directly into the ink reservoir 16, via the portion 44 of said discharge line. This enables ink to be pumped or circulated from the ink reservoir 16, through the ink distributor 20, the print heads 14, the damping distributor 24, and through the degasser 40, back into the ink reservoir 16. The ink may thereby be continuously degassed by the degasser 40, and the ink circuit may be completely filled with degassed ink. The continuous degassing described here for the arrangement 300 is also possible with the arrangement 10 according to FIGS. 1A and 1B.

FIG. 4 shows a workflow diagram for the adjustment of the damping volume of the damping vessel 28, in particular given an ink fill level that is below the discharge line 32, i.e. below the second height H2, according to a first embodiment. The workflow is started with step 410. A positive pressure in the ink reservoir 16 is subsequently generated in step 412. For example, this occurs via the pressure line 54 described in connection with FIGS. 1A and 1B. In a next step 414, ink is then pushed by the positive pressure out of the ink reservoir 16, through the print heads 14, into the damping vessel 28.

In step 416, the damping vessel is then filled by the ink flowing in, and is filled with ink up to the height of the discharge line 32. As soon as the height of the discharge line 32 is reached, the ink, in particular the replenishing ink, flows away via the discharge line 32. Via the method shown in FIG. 4, the damping vessel 28 may be filled and the correct nominal fill level may be automatically ensured, and thus the damping volume of the damping vessel 28 may be adjusted to a preset nominal volume. A manual adjustment of the desired fill level may thereby be dispensed with.

FIG. 5 shows a workflow diagram for the adjustment of the damping volume of the damping vessel 28, in particular given an ink fill level that is below the discharge line 32, i.e. below the second height H2, according to a second embodiment. The workflow begins in step 510. The valves 48, 49, 50, 51, 52 are subsequently set in step 512 so that an ink circuit is established. The conveyor pump 38 is subsequently activated in step 514.

In step 516, a negative pressure is then generated in the damping vessel 28, and air or ink is drawn out of the damping vessel 28 depending on the fill level of the ink in the damping vessel 28. In the subsequent step 518, due to the negative pressure in the damping vessel 28, ink flows out of the ink reservoir 16, via the ink distributor 20, the print heads 14, and the damping distributor 24, into the damping vessel 28. In step 520, the conveyor pump 38 is then stopped, in particular after a preset time. This time is based on experimental values after which the fill level has normally reached the height of the discharge line 32. Alternatively or additionally, an additional fill level sensor may detect that a nominal fill level of the ink in the damping vessel 28 has been reached. The workflow then ends at step 522.

FIG. 6 shows a workflow diagram for the adjustment of the damping volume of the damping vessel 28, in particular given an ink fill level that is above the discharge line 32, i.e. above the second height H2. The workflow begins with step 610. In step 612, the valve 52 is then closed and the additional valves 48, 49, 50, 51 are set so that an ink circuit is established so that ink may flow out of the damping vessel 28, via the discharge line 32, into the ink reservoir 16. In step 614, the ventilating valve 202 of the damping vessel 28 is subsequently opened in order to enable a pressure equalization with the environment. The conveyor pump 38 is activated in step 616.

In step 618, ink is thereupon subsequently drawn from the damping vessel 28 and pumped into the ink reservoir 16. Air replenishes via the ventilating valve 202, and the damping volume increases in size to the extent in which ink is pumped out of the damping vessel 28. In step 620, the conveyor pump 38 is stopped depending on the fill level of the damping vessel. In particular, the conveyor pump is stopped when the fill level of the damping vessel 28 is below a nominal fill level to be detected with the aid of the fill level sensor 212. Alternatively or additionally, the conveyor pump 38 may in particular be stopped after a preset time.

FIG. 7 shows a workflow diagram for the degassing of the ink contained in the ink reservoir 16. The workflow begins with step 710. In step 712, an ink circuit is then established that comprises at least the ink reservoir 16, the degasser 40, and the conveyor pump 56. In step 714, the conveyor pump 56 is subsequently activated. In the next step 716, the degasser 40 is activated. Ink that is pumped through the degasser 40 is degassed with the aid of said degasser 40, so that in particular gases dissolved in the ink are removed.

In step 718, the ink is then circulated through the ink circuit. The circulation ends in particular after a preset time that is in particular based on experimental values. Alternatively, the gas content of the ink may be detected with the aid of a sensor and be compared with a nominal value. Upon reaching or falling below the nominal value, or after expiration of the preset time, the workflow is ended in step 720. This workflow according to FIG. 7 may be implemented both with the arrangement 10 according to FIGS. 1A and 1B and with the arrangement 300 according to FIGS. 3A and 3B.

FIG. 8 shows a workflow diagram for the degassing of the ink distributor 20 and of the damping vessel 28, as well as of additional modules arranged in the ink circuit. The workflow begins in step 810. In step 812, an ink circuit is subsequently established that comprises at least the ink reservoir 16, the ink distributor 20, the print heads 14, the damping distributor 24, the damping vessel 28, the conveyor pump 38, and the degasser 40. The conveyor pump 38 is then activated in step 814.

The degasser 40 is then activated in the next step 816. Ink that is pumped through the degasser 40 is degassed with the aid of said degasser 40. In particular, gases or gas bubbles that are dissolved in the ink are thereby removed. In a step 818, the ink is pumped through the ink circuit with the aid of the conveyor pump 38. The circulation in particular ends after a preset time that is in particular based on experimental values. Alternatively, the gas content of the ink may be detected with the aid of a sensor and be compared with a nominal value. Upon reaching or falling below the nominal value, or after expiration of the preset time, the workflow is ended in step 820.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general-purpose computer.

For the purposes of this discussion, the term "processing circuitry" shall be understood to be circuit(s) or processor(s), or a combination thereof. A circuit includes an analog circuit, a digital circuit, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein. In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

10 Arrangement for supplying ink to a print bar with small pressure fluctuations
11 controller
12 print bar
14 print head
16 ink reservoir
18 supply line
20 ink distributor
22, 30 connecting line
24 damping distributor
26 damping line
28 damping vessel
32 discharge line
34 ink tank
36 immersion tube
38, 56 pump
40 degasser
42 filter
44 portion of the discharge line
46 heat exchanger
48, 50, 52 valve
54 pressure line
200 closure
202 ventilating valve
204 end of the damping line
206 end of the discharge line
208 fill level of the damping vessel
210 head volume of the damping vessel
212 fill level sensor
214 detection region of the fill level sensor
300 arrangement for supplying ink to a print bar with small gas fraction in the ink

The invention claimed is:

1. An arrangement for supplying ink to a print bar with small pressure fluctuations, the arrangement comprising:
an ink reservoir; and
a damping vessel, wherein:

the print bar includes at least two print heads and is connected with the ink reservoir via a supply line, each of the print heads is connected with a damping vessel via at least one damping line, the damping vessel is connected with a discharge line, the end of the damping line ends at a first height in the damping vessel, and the end of the discharge line ends at a second height above the first height in the damping vessel.

2. The arrangement according to claim 1, wherein:

the damping vessel is hermetically sealed and is gas-tightly connected with the damping line and the discharge line; and the arrangement further includes a ventilating valve configured to ventilate the damping vessel.

3. The arrangement according to claim 1, further comprising:

a pump configured to pump the ink to adjust the ink fill level in the damping vessel;

a controller configured to control the pump such that the pump is configured to generate a negative pressure in the damping vessel to draw ink from the ink reservoir, via the print heads and the damping line, into the damping vessel, and/or to draw ink above the discharge line out of the damping vessel.

4. The arrangement according to claim 1, further comprising a compressor configured to generate a positive pressure in the ink reservoir to adjust the ink fill level in the damping vessel, the positive pressuring: pushing the ink out of the ink reservoir, via the supply line, through the print heads, and through the damping line, into the damping vessel, and pushing the ink from the damping vessel into the discharge line upon reaching the second height.

5. The arrangement according to claim 1, wherein the damping line comprises a damping distributor that is connected with the print heads via a respective connecting line and with the damping vessel via the damping line.

6. The arrangement according to claim 1, wherein the supply line comprises an ink distributor that is connected with the print heads via a respective connecting line and with the ink reservoir via the supply line.

7. An arrangement for supplying ink to a print bar with small gas fraction in the ink, the arrangement comprising:

an ink reservoir;

a pump;

a degasser;

a damping vessel; and a controller, wherein:

the print bar includes at least two print heads and is connected with the ink reservoir via a supply line including at least one ink distributor configured to supply ink from the ink reservoir via the supply line, at least one ink distributor being connected with each print head via a respective connecting line, each of the print heads is connected with a discharge line configured to carry discharged ink away from the print heads, the discharge line being configured to resupply the discharged ink to the ink reservoir, the ink reservoir, the supply line, the ink distributor, the print heads, the discharge line, and the pump form an ink circuit, wherein the pump is configured to transport ink through the ink circuit and the degasser, and in a degassing operating mode, the controller is configured to activate the pump to transport ink through the ink circuit to transport the ink through the ink circuit.

8. The arrangement according to claim 7, wherein the controller, in a printing operating mode, is configured to activate the pump such that the print heads, in printing operation, convey ink out of the ink reservoir against a counter-pressure.

9. The arrangement according to claim 8, wherein the ink reservoir and the print heads are arranged relative to one another such that an ink fill level in the ink reservoir lies in a horizontal plane below a horizontal plane in which print nozzles of the print heads are arranged, so that the print heads, upon printing, convey the ink out of the ink reservoir against the counter-pressure.

10. The arrangement according to claim 8, wherein:

the damping vessel is arranged in the discharge line;

a first portion of the discharge line between the print heads and the damping vessel serves as a damping line in the printing operating mode;

one end of the damping line ends at a first height in the damping vessel; and one end of a second portion of the discharge line that leads away from the damping vessel ends at a second height above the first height in the damping vessel.

11. The arrangement according to claim 10, wherein the damping vessel has a fill level sensor, at least for detecting ink above the end of the discharge line in the damping vessel, or above the end of the second portion of the discharge line in the damping vessel.

12. The arrangement according to claim 10, wherein:

the discharge line or the second portion of the discharge line, and/or the damping line, are executed as an immersion line within the damping vessel, or the discharge line or the second portion of the discharge line, and/or the damping line, are connected with a respective lateral opening of the damping vessel.

13. The arrangement according to claim 10, wherein the volume above the second height forms a defined damping volume filled with gas, having a defined damping property in the printing operation of the print bar, and the damping volume damps pressure fluctuations in the arrangement.

14. The arrangement according to claim 10, wherein the damping vessel and the ink reservoir are arranged and designed such that the second height is above a fill level of the ink reservoir.

15. The arrangement according to claim 7, wherein:

the damping vessel, the ink reservoir, the print heads, and at least the damping line form connected vessels; and/or the damping vessel, the ink reservoir, the print heads, at least the damping line, and the discharge line are part of a closed ink circuit, wherein the damping vessel is connectable with the ink reservoir via the discharge line.

* * * * *